US006983055B2

(12) United States Patent
Luo

(10) Patent No.: US 6,983,055 B2
(45) Date of Patent: Jan. 3, 2006

(54) METHOD AND APPARATUS FOR AN ADAPTIVE BINAURAL BEAMFORMING SYSTEM

(75) Inventor: Fa-Long Luo, San Jose, CA (US)

(73) Assignee: GN Resound North America Corporation, Redwood, CA (US)

( * ) Notice: Subject to any disclaimer, the term of this patent is extended or adjusted under 35 U.S.C. 154(b) by 447 days.

(21) Appl. No.: 10/006,086

(22) Filed: Dec. 5, 2001

(65) Prior Publication Data

US 2002/0041695 A1 Apr. 11, 2002

Related U.S. Application Data

(63) Continuation-in-part of application No. 09/593,266, filed on Jun. 13, 2000.

(51) Int. Cl.
*H04R 25/00* (2006.01)

(52) U.S. Cl. ..... 381/313; 381/92; 381/327

(58) Field of Classification Search ..... 381/92, 381/312, 313, 327, 26
See application file for complete search history.

(56) References Cited

U.S. PATENT DOCUMENTS 6,694,028 B1 * 2/2004 Matsuo ..... 381/92

OTHER PUBLICATIONS

J. G. Desloge, et al., "Microphone-Array Hearing Aids with Binaural Output—Part I: Fixed Processing Systems", IEEE Transactions on Speech and Audio Processing, vol. 5, No. 66, Nov. 1997, pp. 529-542.

D. P. Welker, et. al., "Microphone-Array Hearing Aids with Binaural Output—Part II: A Two-Microphone Adaptive System", IEEE Transactions on Speech and Audio Processing, vol. 5, No. 6, Nov. 1997, pp. 543-551.

M. Valente, Ph.D., "Use of Microphone Technology to Improve User Performance in Noise", Trends in Amplification, vol. 4, No. 3, 1999, pp. 112-135.

* cited by examiner

*Primary Examiner*—Brain T. Pendleton
(74) *Attorney, Agent, or Firm*—Bingham McCutchen LLP

(57) ABSTRACT

An adaptive binaural beamforming system is provided which can be used, for example, in a hearing aid. The system uses more than two input signals, and preferably four input signals. The signals can be provided, for example, by two microphone pairs, one pair of microphones located in a user's left ear and the second pair of microphones located in the user's right ear. The system is preferably arranged such that each pair of microphones utilizes an end-fire configuration with the two pairs of microphones being combined in a broadside configuration. Signal processing is divided into two stages. In the first stage, the outputs from the two microphone pairs are processed utilizing an end-fire array processing scheme, this stage providing the benefits of spatial processing. In the second stage, the outputs from the two end-fire arrays are processed utilizing a broadside configuration, this stage providing further spatial processing benefits along with the benefits of binaural processing.

20 Claims, 4 Drawing Sheets

METHOD AND APPARATUS FOR AN ADAPTIVE BINAURAL BEAMFORMING SYSTEM

RELATED APPLICATIONS

The present application is a continuation-in-part of U.S. patent application Ser. No. 09/593,266, filed Jun. 13, 2000, the disclosure of which is incorporated herein in its entirety for any and all purposes.

FIELD OF THE INVENTION

The present invention relates to digital signal processing, and more particularly, to a digital signal processing system for use in an audio system such as a hearing aid.

BACKGROUND OF THE INVENTION

The combination of spatial processing using beamforming techniques (i.e., multiple-microphones) and binaural listening is applicable to a variety of fields and is particularly applicable to the hearing aid industry. This combination offers the benefits associated with spatial processing, i.e., noise reduction, with those associated with binaural listening, i.e., sound location capability and improved speech intelligibility.

Beamforming techniques, typically utilizing multiple microphones, exploit the spatial differences between the target speech and the noise. In general, there are two types of beamforming systems. The first type of beamforming system is fixed, thus requiring that the processing parameters remain unchanged during system operation. As a result of using unchanging processing parameters, if the source of the noise varies, for example due to movement, the system performance is significantly degraded. The second type of beamforming system, adaptive beamforming, overcomes this problem by tracking the moving or varying noise source, for example through the use of a phased array of microphones.

Binaural processing uses binaural cues to achieve both sound localization capability and speech intelligibility. In general, binaural processing techniques use interaural time difference (ITD) and interaural level difference (ILD) as the binaural cues, these cues obtained, for example, by combining the signals from two different microphones.

Fixed binaural beamforming systems and adaptive binaural beamforming systems have been developed that combine beamforming with binaural processing, thereby preserving the binaural cues while providing noise reduction. Of these systems, the adaptive binaural beamforming systems offer the best performance potential, although they are also the most difficult to implement. In one such adaptive binaural beamforming system disclosed by D. P. Welker et al., the frequency spectrum is divided into two portions with the low frequency portion of the spectrum being devoted to binaural processing and the high frequency portion being devoted to adaptive array processing. (*Microphone-array Hearing Aids with Binaural Output-part II: a Two-Microphone Adaptive System,* IEEE Trans. on Speech and Audio Processing, Vol. 5, No. 6, 1997, 543–551).

In an alternate adaptive binaural beamforming system disclosed in co-pending U.S. patent application Ser. No. 09/593,728, filed Jun. 13, 2000, two distinct adaptive spatial processing filters are employed. These two adaptive spatial processing filters have the same reference signal from two ear microphones but have different primary signals corresponding to the right ear microphone signal and the left ear microphone signal. Additionally, these two adaptive spatial processing filters have the same structure and use the same adaptive algorithm, thus achieved reduced system complexity. The performance of this system is still limited, however, by the use of only two microphones.

SUMMARY OF THE INVENTION

An adaptive binaural beamforming system is provided which can be used, for example, in a hearing aid. The system uses more than two input signals, and preferably four input signals, the signals provided, for example, by a plurality of microphones.

In one aspect, the invention includes a pair of microphones located in the user's left ear and a pair of microphones located in the user's right ear. The system is preferably arranged such that each pair of microphones utilizes an end-fire configuration with the two pairs of microphones being combined in a broadside configuration.

In another aspect, the invention utilizes two stages of processing with each stage processing only two inputs. In the first stage, the outputs from two microphone pairs are processed utilizing an end-fire array processing scheme, this stage providing the benefits of spatial processing. In the second stage, the outputs from the two end-fire arrays are processed utilizing a broadside configuration, this stage providing further spatial processing benefits along with the benefits of binaural processing.

In another aspect, the invention is a system such as used in a hearing aid, the system comprised of a first channel spatial filter, a second channel spatial filter, and a binaural spatial filter, wherein the outputs from the first and second channel spatial filters provide the inputs for the binaural spatial filter, and wherein the outputs from the binaural spatial filter provide two channels of processed signals. In a preferred embodiment, the two channels of processed signals provide inputs to a pair of transducers. In another preferred embodiment, the two channels of processed signals provide inputs to a pair of speakers. In yet another preferred embodiment, the first and second channel spatial filters are each comprised of a pair of fixed polar pattern units and a combining unit, the combining unit including an adaptive filter. In yet another preferred embodiment, the outputs of the first and second channel spatial filters are combined to form a reference signal, the reference signal is then adaptively combined with the output of the first channel spatial filter to form a first channel of processed signals and the reference signal is adaptively combined with the output of the second channel spatial filter to form a second channel of processed signals.

In yet another aspect, the invention is a system such as used in a hearing aid, the system comprised of a first channel spatial filter, a second channel spatial filter, and a binaural spatial filter, wherein the binaural spatial filter utilizes two pairs of low pass and high pass filters, the outputs of which are adaptively processed to form two channels of processed signals.

A further understanding of the nature and advantages of the present invention may be realized by reference to the remaining portions of the specification and the drawings.

DESCRIPTION OF THE SPECIFIC EMBODIMENTS

Figure 1:
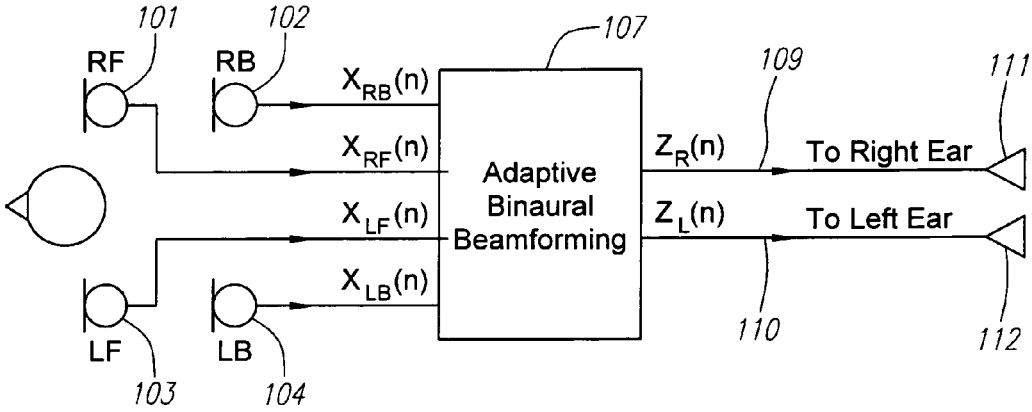
FIG. 1 is an overview schematic of a hearing aid in accordance with the present invention.

FIG. 1 is a schematic drawing of a hearing aid 100 in accordance with one embodiment of the present invention. Hearing aid 100 includes four microphones; two microphones 101 and 102 positioned in an endfire configuration at the right ear and two microphones 103 and 104 positioned in an endfire configuration at the left ear.

In the following description, "RF" denotes right front, "RB" denotes right back, "LF" denotes left front, and "LB" denotes left back. Each of the four microphones 101–104 converts received sound into a signal; $x_{RF}(n)$, $x_{RB}(n)$, $x_{LF}(n)$ and $x_{LB}(n)$, respectively. Signals $x_{RF}(n)$, $x_{RB}(n)$, $x_{LF}(n)$ and $x_{LB}(n)$ are processed by an adaptive binaural beamforming system 107. Within system 107, each microphone signal is processed by an associated filter with frequency responses of $W_{RF}(f)$, $W_{RB}(f)$, $W_{lF}(f)$ and $W_{LB}(f)$, respectively. System 107 output signals 109 and 110, corresponding to $z_R(n)$ and $z_L(n)$, respectively, are sent to speakers 111 and 112, respectively. Speakers 111 and 112 provide processed sound to the user's right ear and left ear, respectively.

To maximize the spatial benefits of system 100 while preserving the binaural cues, the coefficients of the four filters associated with microphones 101–104 should be the solution of the following optimization equation:

$$\min_{W_{RF}(f),W_{RB}(f),W_{LF}(f),W_{LB}(f)} E[|z_L(n)|^2+|z_R(n)^2|] \quad (1)$$

where $C^T W=g$, $E(f)=0$, and $L(f)=0$. In these equations, C and g are the known constrained matrix and vector; W is a weight matrix consisting of $W_{RF}(f)$, $W_{RB}(f)$, $W_{lF}(f)$ and $W_{LB}(f)$; E(f) is the difference in the ITD before and after processing; and L(f) is the difference in the ILD before and after processing. As Eq. (1) is a nonlinear constrained optimization problem, it is very difficult to find the solution in real-time.

Figure 2:
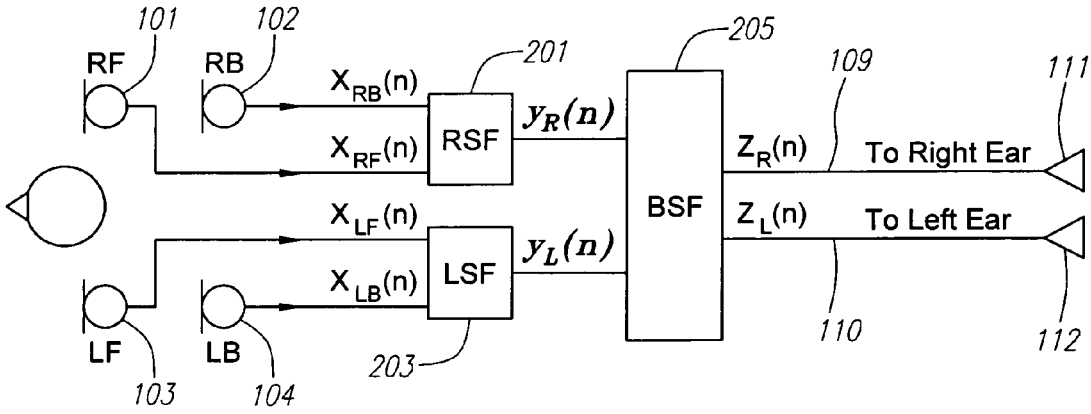
FIG. 2 is a simplified schematic of a hearing aid in accordance with the present invention.

FIG. 2 is an illustration of a simplified system in accordance with the present invention. In this system, processing is performed in two stages. In the first stage of processing, spatial filtering is performed individually for the right channel (ear) and the left channel (ear). Accordingly, $x_{RF}(n)$ and $x_{RB}(n)$ are input to right spatial filter (RSF) 201. RSF 201 outputs a signal $y_R(n)$. Simultaneously, during this stage of processing, $x_{LF}(n)$ and $X_{LB}(N)$ are input to left spatial filter (LSF) 203 which outputs a signal $y_L(n)$. In the second stage of processing, output signals $y_R(n)$ and $y_L(n)$ are input to a binaural spatial filter (BSF) 205. The output signals from BSF 205, $z_R(n)$ 109 and $z_L(n)$ 110, are sent to the user's right and left ears, respectively, typically utilizing speakers 111 and 112.

In the embodiment shown in FIG. 2, the design and implementation of RSF 201 and LSF 203 can be similar, if not identical, to the spatial filtering used in an endfire array of two nearby microphones. Similarly, the design and implementation of BSF 205 can be similar, if not identical, to the spatial filtering used in a broadside array of two microphones (i.e., where $y_R(n)$ and $y_L(n)$ are considered as two received microphones signals).

An advantage of the embodiment shown in FIG. 2 is that there are no binaural issues (e.g., ITD and ILD) in the initial processing stage as RSF 201 and LSF 203 operate within the same ear, respectively. The combination of the binaural cues with spatial filtering is accomplished in BSF 205. As a result, this embodiment offers both design simplicity and a means of being implemented in real-time.

Figure 3:
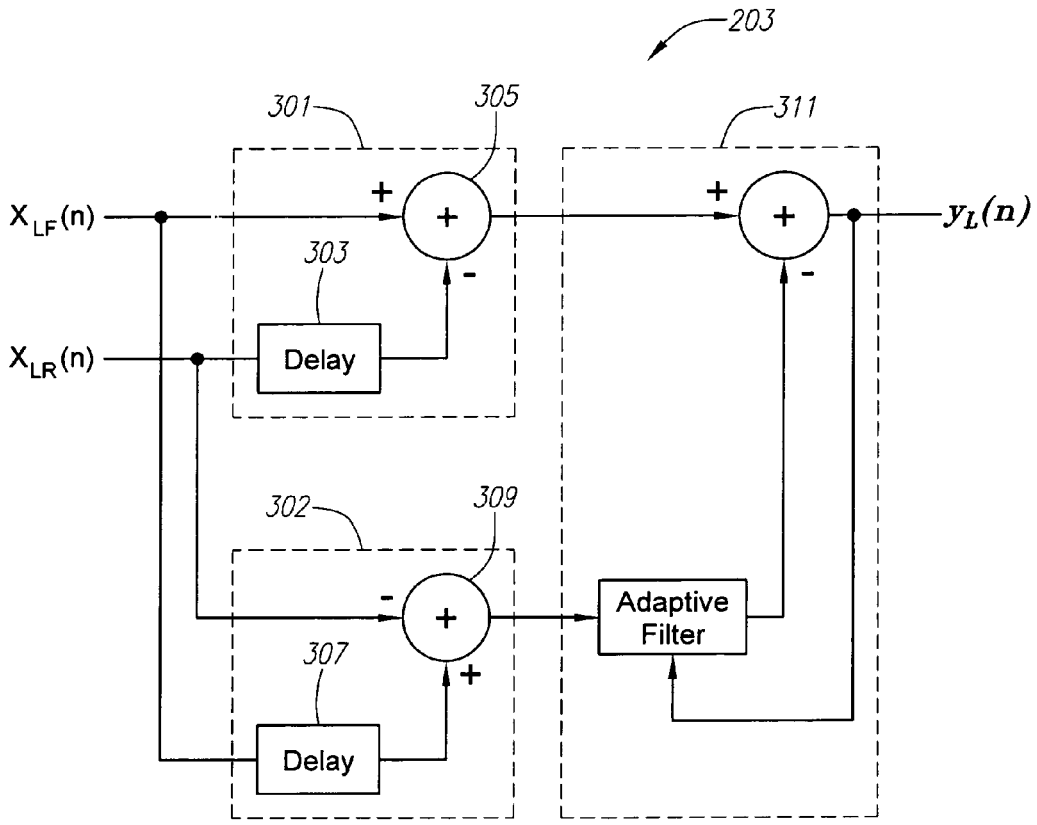
FIG. 3 is a schematic of a spatial filter for use as either the left spatial filter or the right spatial filter of the embodiment shown in FIG. 2.

Further explanation will now be provided for the related adaptive algorithms for RSF 201, LSF 203 and BSF 205. With respect to the adaptive processing of RSF 201 and LSF 203, preferably a fixed polar pattern based adaptive directionality scheme is employed as illustrated in FIG. 3 and as described in detail in co-pending U.S. patent application Ser. No. 09/593,266, the disclosure of which is incorporated herein in its entirety. It should be understood that although the description provided below refers to the structure and algorithm used in LSF 203, the structure and algorithm used in RSF 201 is identical. Accordingly, RSF 201 is not described in detail below. The related algorithms will apply to RSF 201 with replacement of $x_{LF}(n)$ and $x_{LB}(n)$ by $x_{RF}(n)$ and $x_{RB}(n)$, respectively.

The adaptive algorithm for two nearby microphones in an endfire array for LSF 203 is primarily based on an adaptive combination of the outputs from two fixed polar pattern units 301 and 302, thus making the null of the combined polar-pattern of the LSF output always toward the direction of the noise. The null of one of these two fixed polar patterns is at zero (straight ahead of the subject) and the other's null is at 180 degrees. These two polar patterns are both cardioid. The first fixed polar pattern unit 301 is implemented by delaying the back microphone signal $x_{LB}(n)$ by the value d/c with a delay unit 303 and subtracting it from the front microphone signal, $x_{LF}(n)$, with a combining unit 305, where d is the distance separating the two microphones and c is the speed of the sound. Similarly, the second fixed polar pattern unit is implemented by delaying the front microphone signal $x_{LF}(n)$ by the value d/c with a delay unit 307 and subtracting it from the back microphone signal, $x_{LB}(n)$, with a combining unit 309.

The adaptive combination of these two fixed polar patterns is accomplished with combining unit 311 by adding an adaptive gain following the output of the second polar pattern. This combination unit provides the output $y_L(n)$ for next stage BSF 205 processing. By varying the gain value, the null of the combined polar pattern can be placed at different degrees. The value of this gain, W, is updated by minimizing the power of the unit output $y_L(n)$ as follows:

$$W_{opt} = \frac{R_{12}}{R_{22}} \quad (2)$$

where $R_{12}$ represents the cross-correlation between the first polar pattern unit output $x_{L1}(n)$ and the second polar pattern unit $x_{L2}(n)$ and $R_{22}$ represents the power of $X_{L2}(n)$.

In a real-time application, the problem becomes how to adaptively update the optimization gain $W_{opt}$ with available samples $x_{L1}(n)$ and $x_{L2}(n)$ rather than cross-correlation $R_{12}$ and power $R_{22}$. Utilizing available samples $x_{L1}(n)$ and $x_{L2}(n)$, a number of algorithms can be used to determine the optimization gain $W_{opt}$ (e.g., LMS, NLMS, LS and RLS algorithms). The LMS version for getting the adaptive gain can be written as follows:

$$W(n+1)=W(n+1)+\lambda x_{L2}(n)y_L(n) \tag{3}$$

where $\lambda$ is a step parameter which is a positive constant less than 2/P and P is the power of $x_{L2}(n)$.

For improved performance, $\lambda$ can be time varying as the normalized LMS algorithm uses, that is, $$W(n+1) = W(n) + \frac{\mu}{P_{L2}(n)} x_{L2}(n) y_L(n) \tag{4}$$

where $\mu$ is a positive constant less than 2 and $P_{L2}(n)$ is the estimated power of $x_{L2}(n)$.

Equations (3) and (4) are suitable for a sample-by-sample adaptive model.

In accordance with another embodiment of the present invention, a frame-by-frame adaptive model is used. In frame-by-frame processing, the following steps are involved in obtaining the adaptive gain. First, the cross-correlation between $x_{L1}(n)$ and $x_{L2}(n)$ and the power of $x_{L2}(n)$ at the m'th frame are estimated according to the following equations:

$$\hat{R}_{12}(m) = \frac{1}{M}\sum_{n=1}^{M} x_{L1}(n)x_{L2}(n) \tag{5}$$

$$\hat{R}_{22}(m) = \frac{1}{M}\sum_{n=1}^{M} x_{L2}^2(n) \tag{6}$$

where M is the sample number of a frame. Second, $R_{12}$ and $R_{22}$ of Equation (2) are replaced with the estimated $R_{12}$ and $R_{22}$ and then the estimated adaptive gain is obtained by Eqn.(2).

In order to obtain a better estimation and achieve smoother frame-by-frame processing, the cross-correlation between $x_{L1}(n)$ and $x_{L2}(n)$ and the power of $x_{L2}(n)$ at the m'th frame can be estimated according to the following equations:

$$\hat{R}_{12}(m) = \frac{\alpha}{M}\sum_{n=1}^{M} x_{L1}(n)x_{L2}(n) + \beta\hat{R}_{12}(m-1) \tag{7}$$

$$\hat{R}_{22}(m) = \frac{\alpha}{M}\sum_{n=1}^{M} x_{L2}^2(n) + \beta\hat{R}_{22}(m-1) \tag{8}$$

where $\alpha$ and $\beta$ are two adjustable parameters and where $0 \leqq \alpha \leqq 1$, $0 \leqq \beta \leqq 1$, and $\alpha+\beta=1$. Obviously if $\alpha=1$ and $\beta=0$, Equations (7) and (8) become Equations (5) and (6), respectively.

As previously noted, the adaptive algorithms described above also apply to RSF 201, assuming the replacement of $x_{LF}(n)$ and $x_{LB}(n)$ with $x_{RF}(n)$ and $x_{RB}(n)$, respectively.

Figure 4:
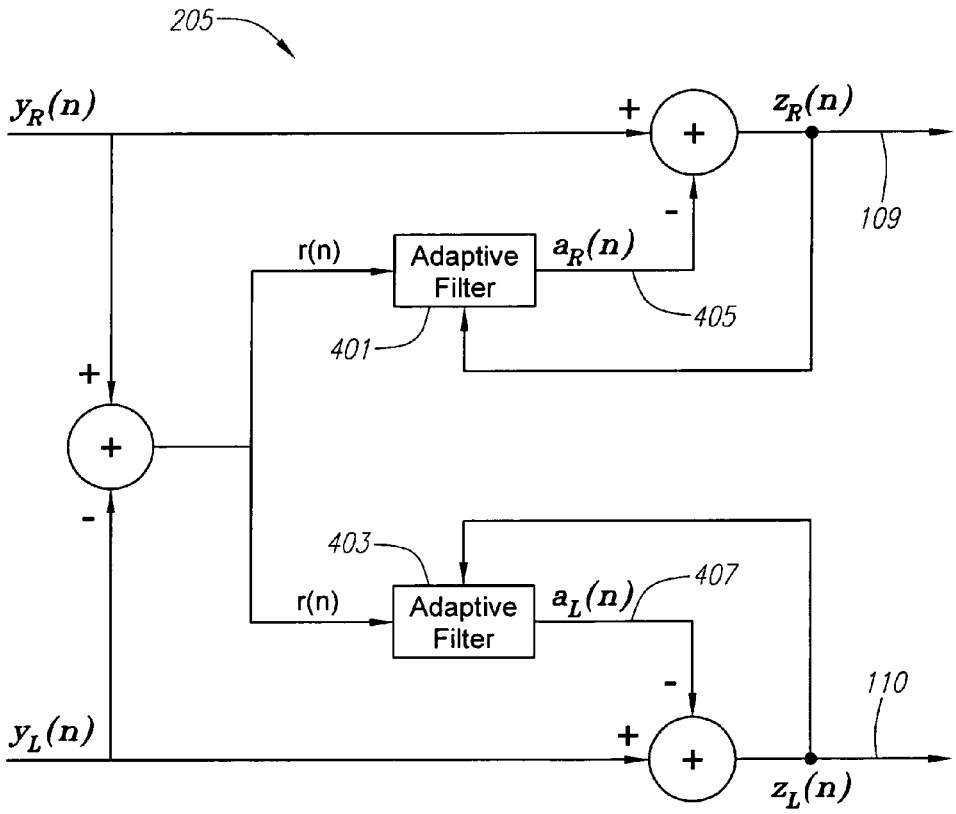
FIG. 4 is a schematic of a binaural spatial filter for use in the embodiment shown in FIG. 2.

Since BSF 205 has only two inputs and is similar to the case of a broadside array with two microphones, the implementation scheme illustrated in FIG. 4 can be used to achieve the effective combination of the spatial filtering and binaural listening. In this implementation of BSF 205, the reference signal r(n) comes from the outputs of RSF 201 and LSF 203 and is equivalent to $y_R(n)$-$y_L(n)$. Reference signal r(n) is sent to two adaptive filters 401 and 403 with the weights given by:

$$W_R(n)=[W_{R1}(n), W_{R2}(n), \ldots, W_{RN}(n)]^T \text{ and}$$

$$W_L(n)=[W_{L1}(n), W_{L2}(n), \ldots, W_{LN}(n)]^T$$

Adaptive filters 401 and 403 provide the outputs 405 ($a_R(n)$) and 407 ($a_L(n)$), respectively, as follows:

$$a_R(n) = \sum_{m=1}^{M} W_{Rm}(n)r(n-m+1) = W_R^T(n)R(n) \tag{9}$$

$$a_L(n) = \sum_{m=1}^{M} W_{Lm}(n)r(n-m+1) = W_L^T(n)R(n) \tag{10}$$

where $R(n)=[r(n), r(n-1), \ldots, r(n-N+1)]^T$ and N is the length of adaptive filters 401 and 403. Note that although the length of the two filters is selected to be the same for the sake of simplicity, the lengths could be different. The primary signals at adaptive filters 401 and 403 are $y_R(n)$ and $y_L(n)$. Outputs 109 ($z_R(n)$) and 110 ($z_L(n)$) are obtained by the equations:

$$z_R(n)=y_R(n)-a_R(n) \tag{11}$$

$$z_L(n)=y_L(n)-a_L(n) \tag{12}$$

The weights of adaptive filters 401 and 403 are adjusted so as to minimize the average power of the two outputs, that is, $$\min_{W_R(n)} E(|z_R(n)^2|) = \min_{W_R(n)} E(|y_R(n)-a_R(n)|^2) \tag{13}$$

$$\min_{W_L(n)} E(|z_L(n)^2|) = \min_{W_L(n)} E(|y_L(n)-a_L(n)|^2) \tag{14}$$

In the ideal case, r(n) contains only the noise part and the two adaptive filters provide the two outputs $a_R(n)$ and $a_L(n)$ by minimizing Equations (13) and (14). Accordingly, the two outputs should be approximately equal to the noise parts in the primary signals and, as a result, outputs 109 (i.e., $z_R(n)$) and 110 (i.e., $z_L(n)$) of BSF 205 will approximate the target signal parts. Therefore the processing used in the present system not only realizes maximum noise reduction by two adaptive filters but also preserves the binaural cues contained within the target signal parts. In other words, an approximate solution of the nonlinear optimization problem of Equation (1) is provided by the present system.

Regarding the adaptive algorithm of BSF 205, various adaptive algorithms can be employed, such as LS, RLS, TLS and LMS algorithms. Assuming an LMS algorithm is used, the coefficients of the two adaptive filters can be obtained from:

$$W_R(n+1)=W_R(n)+\eta R(n)z_R(n) \tag{15}$$

$$W_L(n+1)=W_L(n)+\eta R(n)x_L(n) \tag{16}$$

where $\eta$ is a step parameter which is a positive constant less than 2/P and P is the power of the input r(n) of these two adaptive filters. The normalized LMS algorithm can be obtained as follows:

$$W_R(n+1) = W_R(n) + \frac{\mu}{\|R(n)\|^2} R(n) z_R(n) \tag{17}$$

$$W_L(n+1) = W_L(n) + \frac{\mu}{\|R(n)\|^2} R(n) z_L(n) \tag{18}$$

where $\mu$ is a positive constant less than 2.

Based on the frame-by-frame processing configuration, a further modified algorithm can be obtained as follows:

$$W_{Rk}(n+1) = W_{Rk}(n) + \frac{\mu}{\|R(n)\|^2} R(n) z_{Rk}(n) \tag{19}$$

$$W_{Lk}(n+1) = W_{Lk}(n) + \frac{\mu}{\|R(n)\|^2} R(n) z_{Lk}(n) \tag{20}$$

where k represents the k'th repeating in the same frame. It is noted that the frame-by-frame algorithm in LSF is different from that for the BSF primarily because in LSF only an adaptive gain is involved.

Figure 5:
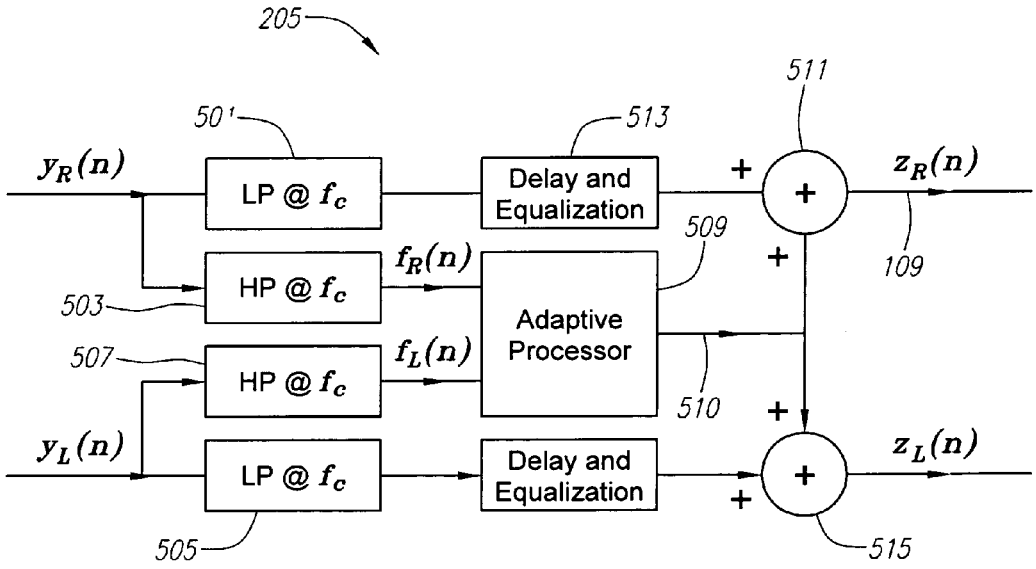
FIG. 5 is a schematic of an alternate binaural spatial filter for use in the embodiment shown in FIG. 2.

FIG. 5 illustrates an alternate embodiment of BSF 205. In this embodiment, output $y_R(n)$ of RSF 201 is split and sent through a low pass filter 501 and a high pass filter 503. Similarly, the output $y_L(n)$ of LSF 203 is split and sent through a low pass filter 505 and a high pass filter 507. The outputs from high pass filters 503 and 507 are supplied to adaptive processor 509. Output 510 of adaptive processor 509 is combined using combiner 511 with the output of low pass filter 501, the output of low pass filter 501 first passing through a delay and equilization unit 513 before being sent the combiner. The output of combiner 511 is signal 109 (i.e., $z_R(n)$). Similarly, output 510 is combined using combiner 515 in order to output signal 110 (i.e., $z_L(n)$).

In yet another alternate embodiment of BSF 205, a fixed filter replaces the adaptive filter. The fixed filter coefficients can be the same in all frequency bins. If desired, delay-summation or delay-subtraction processing can be used to replace the adaptive filter.

In yet another alternate embodiment, the adaptive processing used in RSF 201 and LSF 203 is replaced by fixed processing. In other words, the first polar pattern units $x_{L1}(n)$ and $x_{R1}(n)$ serve as outputs $y_L(n)$ and $y_R(n)$, respectively. In this case, the delay could be a value other than d/c so that different polar patterns can be obtained. For example, by selecting a delay of 0.342 d/c, a hypercardioid polar pattern can be achieved.

In yet another alternate embodiment, the adaptive gain in RSF 201 and LSF 203 can be replaced by an adaptive FIR filter. The algorithm for designing this adaptive FIR filter can be similar to that used for the adaptive filters of FIG. 4. Additionally, this adaptive filter can be a non-linear filter.

As will be understood by those familiar with the art, the present invention may be embodied in other specific forms without departing from the spirit or essential characteristics thereof. For example, although an LMS-based algorithm is used in RSF 201, LSF 203 and BSF 205, as previously noted, LS-based, TLS-based, RLS-based and related algorithms can be used with each of these spatial filters. The weights could also be obtained by directly solving the estimated Wienner-Hopf equations. Accordingly, the disclosures and descriptions herein are intended to be illustrative, but not limiting, of the scope of the invention which is set forth in the following claims.

What is claimed is:

1. An apparatus comprising:

a first end-fire array comprising a first microphone configured for outputting a first microphone signal, and a second microphone configured for outputting a second microphone signal;

a second end-fire array comprising a third microphone configured for outputting a third microphone signal, and a fourth microphone configured for outputting a fourth microphone signal;

a first channel spatial filter configured for receiving said first and second microphone signals, and for outputting a first output signal;

a second channel spatial filter configured for receiving said third and fourth microphone signals, and for outputting a second output signal; and a binaural spatial filter configured for receiving said first and second output signals and for outputting a first channel output signal and a second channel output signal without separating each of said first and second output signals into low and high frequency spectrum portions.

2. The apparatus of claim 1, wherein said apparatus is a hearing aid, wherein said first and second microphones are configured for being placed proximate to a user's left ear, and wherein said third and fourth microphones are configured for being placed proximate to a user's right ear.

3. The apparatus of claim 1, further comprising:

a first output transducer configured for converting said first channel output signal to a first channel audio output; and a second output transducer configured for converting said right channel output signal to a second channel audio output.

4. An apparatus comprising:

a first channel spatial filter configured for receiving a first input signal and a second input signal and for outputting a first output signal;

a second channel spatial filter configured for receiving a third input signal and a fourth input signal and for outputting a second output signal; and a binaural spatial filter configured for receiving said first and second output signals and for outputting a first channel output signal and a second channel output signal;

wherein one of said first and second channel spatial filters comprises:

a first fixed polar pattern unit configured for outputting a first unit output;

a second fixed polar pattern unit configured for outputting a second unit output; and a first combining unit comprising a first adaptive filter and configured for receiving said first and second unit outputs and for outputting said first output signal.

5. The apparatus of claim 4, wherein the other of said first and second channel spatial filters comprises:

a third fixed polar pattern unit configured for outputting a first unit output;

a fourth fixed polar pattern unit configured for outputting a second unit output; and a second combining unit comprising a first adaptive filter, wherein said first combining unit is configured for receiving said first and second unit outputs and for outputting said first output signal.

6. The apparatus of claim 4, further comprising first, second, third, and fourth microphones configured for respectively outputting said first, second, third, and fourth input signals.

7. The apparatus of claim 6, wherein said first microphone and said second microphone are positioned in a first end-fire array and wherein said third microphone and said fourth microphone are positioned in a second end-fire array.

8. The apparatus of claim 6, wherein said apparatus is a hearing aid, wherein said first and second microphones are configured for being placed proximate to a user's left ear, and wherein said third and fourth microphones are configured for being placed proximate to a user's right ear.

9. The apparatus of claim 6, further comprising:

a first output transducer configured for converting said first channel output signal to a first channel audio output; and a second output transducer configured for converting said right channel output signal to a second channel audio output.

10. An apparatus comprising:

a first channel spatial filter configured for receiving a first input signal and a second input signal and for outputting a first output signal;

a second channel spatial filter configured for receiving a third input signal and a fourth input signal and for outputting a second output signal; and a binaural spatial filter comprising:

a first combining unit configured for combining said first and second output signals and for outputting a reference signal;

a first adaptive filter configured for receiving said reference signal and outputting a first adaptive filter output;

a second combining unit configured for combining said first output signal with said first adaptive filter output and for outputting a first channel output signal;

a second adaptive filter configured for receiving said reference signal and outputting a second adaptive filter output; and a third combining unit configured for combining said second output signal with said second adaptive filter output and for outputting a second channel output signal.

11. The apparatus of claim 10, further comprising first, second, third, and fourth microphones configured for respectively outputting said first, second, third, and fourth input signals.

12. The apparatus of claim 11, wherein said first microphone and said second microphone are positioned in a first end-fire array and wherein said third microphone and said fourth microphone are positioned in a second end-fire array.

13. The apparatus of claim 11, wherein said apparatus is a hearing aid, wherein said first and second microphones are configured for being placed proximate to a user's left ear, and wherein said third and fourth microphones are configured for being placed proximate to a user's right ear.

14. The apparatus of claim 11, further comprising:

a first output transducer configured for converting said first channel output signal to a first channel audio output; and a second output transducer configured for converting said right channel output signal to a second channel audio output.

15. A hearing aid, comprising:

a first microphone configured for outputting a first microphone signal;

a second microphone configured for outputting a second microphone signal, wherein said first and second microphones are configured for being positioned as a first end-fire array proximate to a user's left ear;

a third microphone configured for outputting a third microphone signal;

a fourth microphone configured for outputting a fourth microphone signal, wherein said third and fourth microphones are configured for being positioned as a second end-fire array proximate to a user's right ear;

a left spatial filter comprising:

a first fixed polar pattern unit configured for outputting a first unit output;

a second fixed polar pattern unit configured for outputting a second unit output; and a first combining unit comprising a first adaptive filter and configured for receiving said first and second unit outputs and for outputting a left spatial filter output signal.

a right spatial filter comprising:

a third fixed polar pattern unit configured for outputting a third unit output;

a fourth fixed polar pattern unit configured for outputting a fourth unit output; and a second combining unit comprising a second adaptive filter and configured for receiving said third and fourth unit outputs and for outputting a right spatial filter output signal;

a binaural spatial filter comprising:

a third combining unit configured for combining said left spatial filter output signal and said right spatial filter output signal and for outputting a reference signal;

a third adaptive filter configured for receiving said reference signal;

a fourth combining unit configured for combining said left spatial filter output signal with a third adaptive filter output and for outputting a left channel output signal;

a fourth adaptive filter configured for receiving said reference signal; and a fifth combining unit configured for combining said right spatial filter output signal with a fourth adaptive filter output and for outputting a right channel output signal;

a first output transducer configured for converting said left channel output signal to a left channel audio output; and a second output transducer configured for converting said right channel output signal to a right channel audio output.

16. A method of processing sound, comprising the steps of:

receiving a first input signal from a first microphone;

receiving a second input signal from a second microphone;

providing said first and second input signals to a first fixed polar pattern unit;

providing said first and second input signals to a second fixed polar pattern unit;

adaptively combining a first fixed polar pattern unit output and a second fixed polar pattern unit output to form a first channel binaural filter input;

receiving a third input signal from a third microphone;

receiving a fourth input signal from a fourth microphone;

providing said third and fourth input signals to a third fixed polar pattern unit;

providing said third and fourth input signals to a fourth fixed polar pattern unit;

adaptively combining a third fixed polar pattern unit output and a fourth fixed polar pattern unit output to form a second channel binaural filter input;

combining said first channel binaural filter input and said second channel binaural filter input to form a reference signal;

adaptively combining said reference signal with said first channel binaural filter input to form a first channel output signal; and adaptively combining said reference signal with said second channel binaural filter input to form a second channel output signal.

17. The method of claim 16, further comprising the steps of:

converting said first channel output signal to a first channel audio signal; and converting said second channel output signal to a second channel audio signal.

18. The method of claim 16, wherein said step of adaptively combining said first fixed polar pattern unit output and said second fixed polar pattern unit output to form said first channel binaural filter input further comprises the step of varying a first gain value to position a first null corresponding to said first channel binaural filter input, and wherein said step of adaptively combining said third fixed polar pattern unit output and said fourth fixed polar pattern unit output to form said second channel binaural filter input further comprises the step of varying a second gain value to position a second null corresponding to said second channel binaural filter input.

19. The method of claim 16, wherein said steps of adaptively combining utilize an LS algorithm.

20. The method of claim 16, wherein said steps of adaptively combining utilize one of an RLS algorithm, TLS algorithm, NLMS algorithm, and LMS algorithm.

* * * * *